United States Patent [19]

Winrow

[11] 4,426,799

[45] Jan. 24, 1984

[54] VANE OPERATED DISPLAY OR INDICATING DEVICE

[75] Inventor: Donald Winrow, Weston, Canada

[73] Assignee: Nei Canada Limited, Toronto, Canada

[21] Appl. No.: 390,311

[22] Filed: Jun. 21, 1982

[51] Int. Cl.[3] ..... G09F 9/00

[52] U.S. Cl. ..... 40/449; 40/485; 40/474

[58] Field of Search ..... 40/452, 447, 486, 449, 40/495, 496, 430, 433, 435, 487, 485; 340/815.04, 815.05

[56] References Cited

U.S. PATENT DOCUMENTS

| | | | |
|---|---|---|---|
| 1,481,256 | 1/1924 | Dols | 46/238 |
| 1,547,864 | 7/1925 | Etcheto | 40/486 |
| 3,149,430 | 9/1964 | Szabo et al. | 40/447 |
| 3,295,238 | 1/1967 | Winrow | 40/449 |
| 3,315,389 | 4/1967 | Drueck, Jr. | 40/435 |
| 3,419,858 | 12/1968 | Silverman et al. | 340/815.04 |
| 4,211,414 | 7/1980 | Moodt | 46/238 |

*Primary Examiner*—Gene Mancene
*Assistant Examiner*—Wenceslao J. Contreras
*Attorney, Agent, or Firm*—Westell & Hanley

[57] ABSTRACT

A display or indicator element has a set of movable and a set of fixed vanes of contrasting colors. Each set of vanes encompasses what is substantially a circle in the viewing direction. The sets of vanes are arranged so that the moving vanes move between a position where they are hidden (in the viewing direction) behind the stationary vanes and a position where the moving vanes occlude the stationary vanes. In such movements each moving vane passes between a pair of stationary vanes. Accordingly, contrasting effects are produced. Preferably the actuation for the movable vanes is electromagnetic.

8 Claims, 11 Drawing Figures

Figure 3:
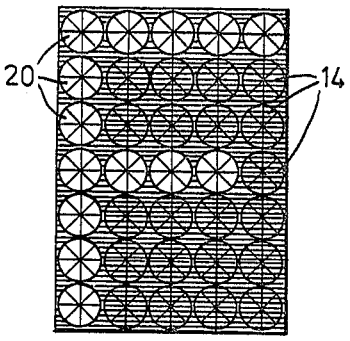

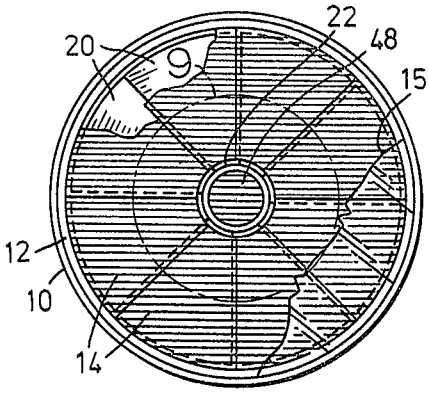
FIG. 1
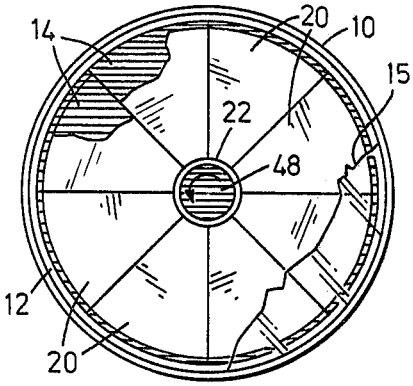
FIG. 2
FIG. 4
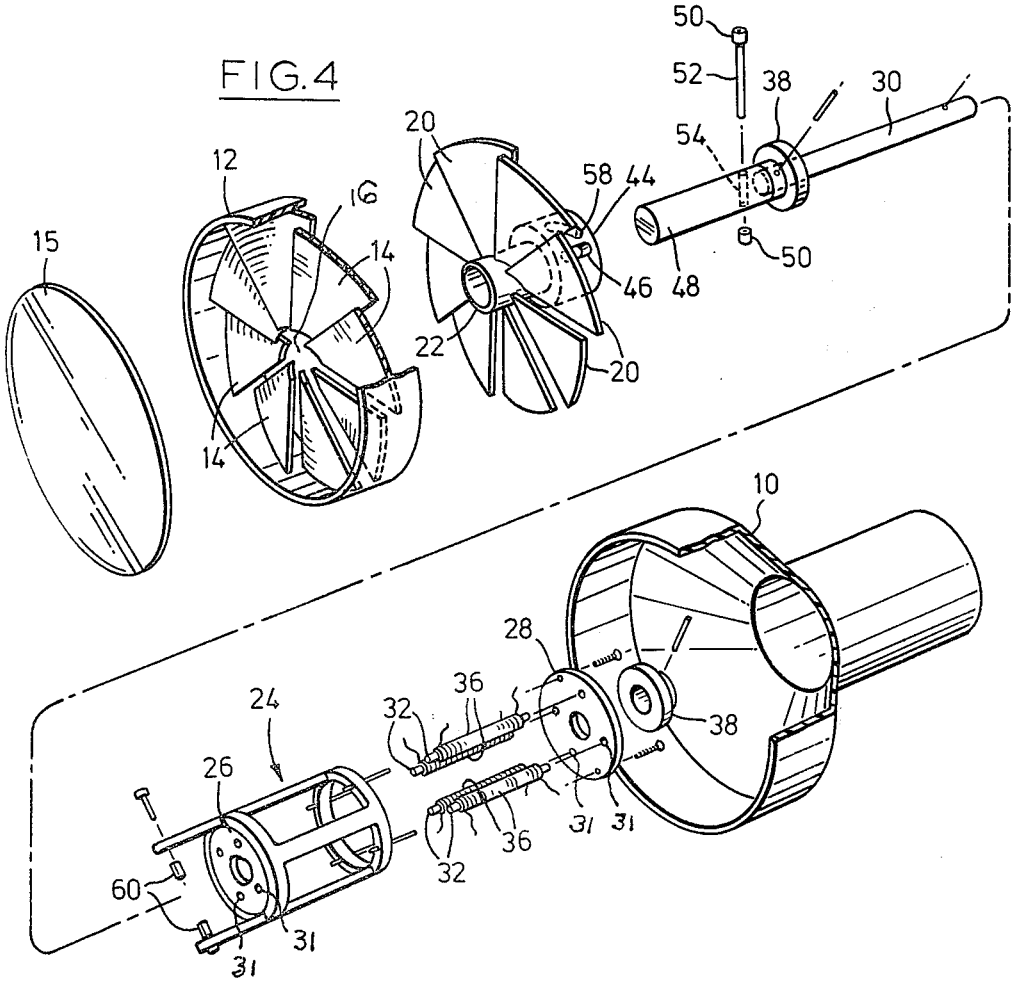

VANE OPERATED DISPLAY OR INDICATING DEVICE

This invention relates to a display or indicating element to be illuminated by ambient light.

The display elements or indicators with which the invention is concerned are those which in which a movable display member moves between two limiting positions. Such display members in one limiting position display, at a location in a viewing direction, a surface of one colour in the viewing direction, while in the other limiting position they are arranged so that at the same location, a contrasting colour is displayed in the viewing direction. Examples of such display elements where the movable display member is in the form of a bar having a face contrasting with a background where the two limiting positions are 120° apart and where the contrasting colour in the second limiting position is due to the occlusion or substantial non-visibility of the contrasting face are:

| U.S. Pat. No. | Inventor |
|---|---|
| 3,537,197 | C. N. Smith |
| 3,624,647 | C. N. Smith |

Examples of such display elements (where the movable member is usually in the form of a round disc) where the two limiting positions are 165°–180° apart and the colour on one side of the disc contrasts with the background while the colour on the other side blends with the background; are:

| U.S. Pat. No. | Inventor | Date |
|---|---|---|
| 3,303,654 | M. K. Taylor | Feb 7, 1967 |
| DES 241,081 | D. Winrow | Aug 17, 1976 |
| 3,991,496 | G. Helwig et al | Nov 16, 1976 |
| 3,624,941 | S. W. F. Chantry | Dec 7, 1971 |
| 3,996,680 | C. N. Smith | Dec 14, 1976 |
| 3,975,728 | D. Winrow | Aug 17, 1976 |
| 3,469,258 | D. Winrow | Sept 23, 1969 |

U.S. Pat. No. 4,223,464 to D. Winrow dated Sept. 23, 1980 shows a display member using a movable element which is a bar or disc, where a pair of permanent magnets are provided at spaced locations on the movable element. The mounting for the movable element carries at least one and preferably two longitudinally extending permanent reversibly magnetizable members with a pair of free ends just inward of the locus of the permanent magnets. The relative location of the permanently magnetizable members and of such locus was such that reversal of the magnetization of such longitudinally extending magnetizable members caused the bar or disc to move from display of one of its faces to a position occluding such face. Moreover the location of the permanent magnets outward of the magnetizable members' free ends meant that on reversal of the latter's magnetization, the permanent magnets were each initially repelled the axial component of this repulsion created axial spacing between the movable and stationary members during the initial movement of the former and the resultant low friction for the movable member was achieved when most required.

The patents referred to above represent the most relevant prior art known to applicant.

With the dot or disc type display or indicator elements referred to above, the depth of the locus of the moving disc was at least its diameter. Such depth increased the problems of housing and protecting the disc in use and the thickness of the display. An example only of the problems of this type is that encountered when frosted glass is used in front of the display to cut down on undesired reflections. It is well known that loss of definition of the display member behind such frosted glass is very high unless it is in very close proximity to the frosted glass. However, due to the geometric shape of a disc and the fact that (usually) it is rotated about its diameter required a spacing of the pivotal axis of disc from the frosted glass of at least ½ the disc diameter. This caused a large loss of definition when the contrasting face of the disc was displayed. Those patents which used a bar with a shutter effect to occlude a display bar at the end of a lever required a shallower depth for movement of the display element (excluding the mechanism) but were difficult to power adequately and were mechanically complex.

Moreover, both the disc type and bar type were relatively air resistant in movement and for this and other reasons were difficult to switch at high speeds.

Moreover, both the disc type and bar type were size limited in the sense that power and material costs increased greatly with increasing size.

The term "wide circular annulus" is used herein to define the shape of a circle with a relatively small circular centre of (in one position) contrasting colour. For display purposes would be desirable to have the entire circle uniform. However, due to the mechanism used, the small centre of the circle will not be uniform in one display position.

This invention provides a display element wherein a plurality of stationary vanes, which together encompass substantially 360° of a wide circular annulus in the viewing direction, define paths for similar movable vanes which are rotational with a small axial component and which move between two limiting positions. In one limiting position the movable vanes are behind similar fixed vanes and hence occluded in the viewing direction. In the other limiting position the movable vanes have rotated and moved forward (i.e. toward the viewer) from their occluded position each movable vane moving between a pair of fixed vanes to a position where the movable vanes occlude the fixed vanes in the viewing direction. Since the fixed vanes and the background of the display are of one colour and the moving vanes of a contrasting colour, a display or indicating element is provided having two contrasting appearances which is very suitable for large multiple displays employing many of such elements.

Such the motion of such moving vanes has a very small component in the axial or viewing direction, the depth (in the viewing direction) of space taken by the display vanes is very small, and much smaller than with the disc examples in the patents referred to above. Thus the vanes of the new invention are very suitable for use with frosted protecting glass in contrast to the disc example given above.

Moreover, the vane type display element lends itself to easy and efficient magnetic drive and has been found to switch at much higher speeds than disc or bar devices. Lack of air resistance to the helical type movement also increases such speed.

Moreover, the vane type display element is nearly as light as the discs used with the devices in the prior patents referred to and much lighter than the bar type mechanisms. The lightness of the vane type device renders possible the provision of very large size devices.

By "forward" and "rearward" herein I refer to the portions of the element nearer and further, respectively, to and from the viewer.

Figure 9:
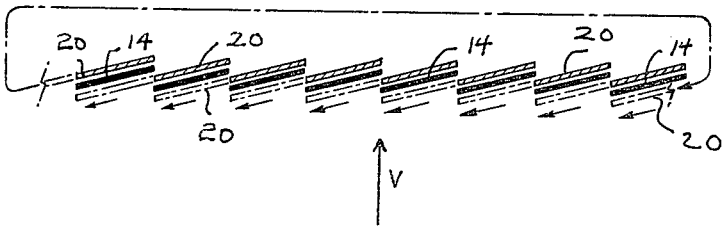
Figure 10:
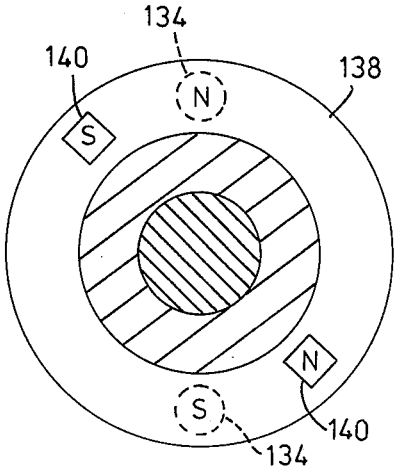
Figure 11:
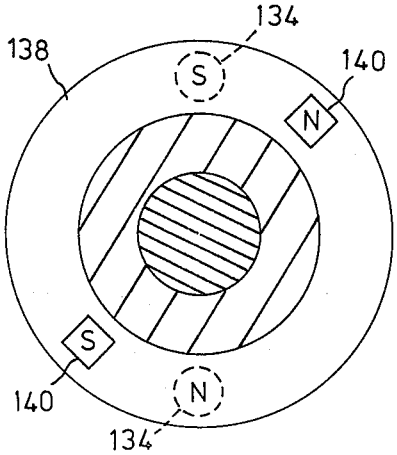
Figure 5:
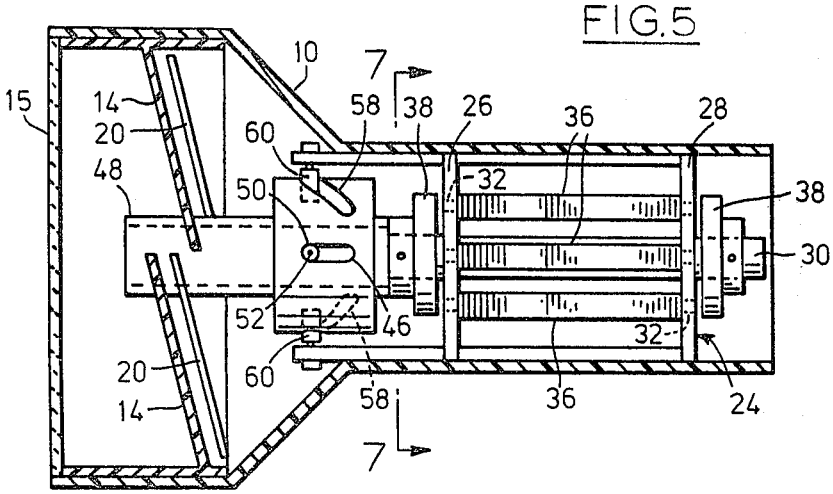
Figure 6:
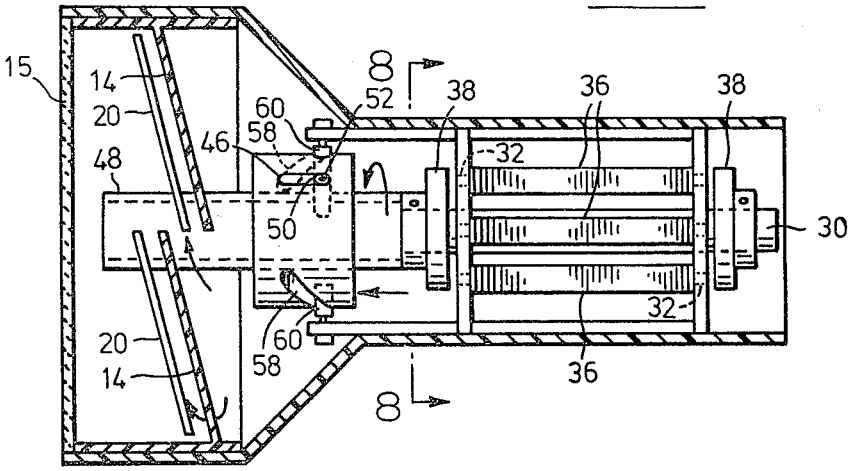
Figure 7:
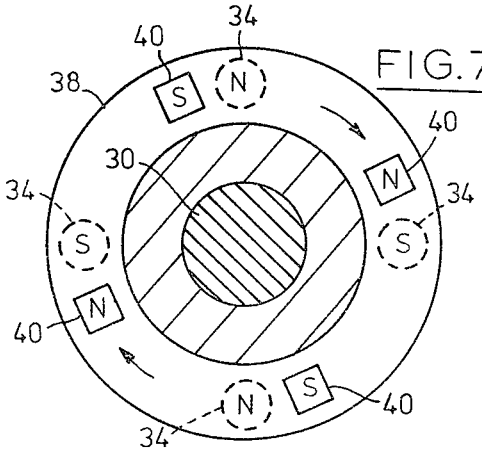
Figure 8:
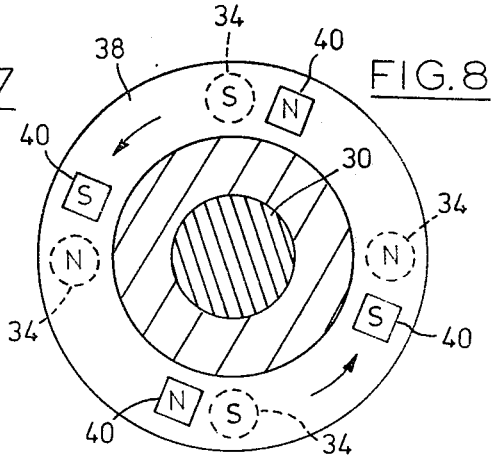

In drawings which illustrate a preferred embodiment of the invention:

FIG. 1 shows a display or indicator element viewed in the viewing direction showing its darker (usually background) colour;

FIG. 2 shows element of FIG. 1 showing its lighter (usually contrasting with the background) colour, FIG. 3 shows a 7×5 array of elements of the type of FIGS. 1 and 2 arranged to portray the letter "F", FIG. 4 is an exploded perspective view of the device shown in FIGS. 1 and 2, FIGS. 5 and 6 are side views of the element in the position corresponding to FIGS. 1 and 2 respectively, FIGS. 7 and 8 are schematic indications of the magnetic drive corresponding respectively to FIGS. 1 and 2, FIG. 9 is a circular section in the viewing direction taken on the line of FIGS. 1 and 2 and shown as a linear development, FIGS. 10 and 11 show an alternative arrangement of cores and magnets to that shown in the preferred embodiment.

The drawings show a broken away view of a mounting casing 10 mounting at the front of circular outer ring 12 (fixed in casing 10 in any desired manner) supporting inwardly extending stationary vane 14. The casing 10 will, in some applications, be closed by transparent glass or plastic 15 attached, in any desired manner to the front of outer ring 12. As best illustrated in FIG. 1, such vane sectors 14, when viewed in the viewing direction together encompass a wide circular annulus extending 360° about the centre (8 vanes of 45° arc each) with a small aperture 16 in the middle. As viewed in perspective, it will be seen that such fixed vanes 14 are each spaced and oriented relative to adjacent vanes 14 and to the viewing direction to allow the helical travel of similar vanes 20 therebetween (reference may also be made to the development of FIG. 9). Thus, as best shown in FIG. 4, movable vanes 20 each subtending 45°, mounted on a central sleeve 22, of the same size as and of contrasting colour to the stationary vanes 14, may move 45° from a position (FIG. 1 and solid line position of FIG. 9) where each movable vane 20 is occluded in the viewing direction indicated by the arrow "V" in FIG. 9 by a fixed vane 14 (and hence only fixed vanes 14 are seen) to a position where each movable vane 20 occludes a fixed vane 14 (FIG. 2 and dotted line position of FIG. 9) (and only movable vanes are seen). By a movement of 45° in the other direction from the position of FIG. 2 (clockwise in the Figures) the movable vanes 20 may be again hidden behind the fixed vanes 14 (having returned to the position of FIG. 1). It is noted that the axial movement, or movement in the viewing direction, during such 45° rotation is only slightly more than twice the thickness of the vanes.

To give an overview for the use of the invention it will be noted that when used in an array the dark appearance of FIG. 1 will usually match the background of the array and the white or light appearance of FIG. 2 will customarily contrast with the background. Thus, FIG. 3 shows 35 elements in accord with the invention arranged in 7 rows and 5 columns. These elements may be selectively energized in accord with techniques well known to those skilled in the art. In FIG. 3 the elements are shown selectively actuated so that the white displaying elements outline the letters 'F'. As many such 35 element modules may be used as required for the messages desired. The elements will be located as close to each other as possible and the modules (usually) as close to each other as possible in order to achieve the maximum effect from the array. (The modules may be spaced to provide letter and line spacing.)

Display or indicator elements in accord with the invention may also be used singly as binary indicators. As such they may show arrows, letters or any desired indicia on one set (preferably the movable set) of the fixed and movable set of the vane faces.

The preferred drive for the vanes will now be described. It bears a number of similarities to the drive described for the bar or disc of U.S. Pat. No. 4,223,464 referred to above.

A hollow frame 24 for fixed mounting in a housing 10 (in any desired manner) carries end members 26 and 28 which are apertured to rotatably mount a central rotatable shaft 30 extending longitudinally of the frame. Mounted in four holes 31 formed in each of end members 26 and 28 are four longitudinally extending reversible permanently magnetizable core members 32 arranged parallel to the shaft and equiangularly spaced thereabout. The reversibly magnetizable members each have two free ends 34 thus, looking at each end of the device (see FIGS. 7 and 8) there are four pole pieces at 90° angularly spacing from each other about the central shaft 30. An energizing winding 36 for reversibly magnetizing each core 32 is provided. Although the control of the energization for such windings 36 is not part of this invention, it should be noted that at any time the control energization will be such that at one end the four core ends will have alternating polarity about the centre shaft 30. The four windings 36 are energized together to effect the switching of magnetization so that all members are reversed simultaneously. Thus FIG. 7 shows four ends 34 with one sense of magnetization, i.e. NSNS starting from the 12 o'clock position and FIG. 8 shows the same four ends with the magnetization of the cores reversed, that is ends are then magnetized SNSN starting at the same position.

Each individual core 32 is of course magnetized at any given time so that it has a north (N) pole at one end and a south (S) at the other. Thus the ends 34, remote from the viewing direction will have the opposite polarity in the case of each core from the polarity shown in FIGS. 7 and 8 respectively.

On shaft 30, and just outward in an axial direction of the respective pole piece ends, discs 38 of permanent magnetic material are provided rotatable with the shaft and having four poles disposed equiangularly about the axis and again alternating NSNS. The magnets fixed to rotate with the shaft and are located just axially outward of the pole piece ends. Preferably magnetic discs 38 are constructed of a nylon based material having barium ferrite distributed therein. Such disc, of such material may be magnetized in the pattern of polarized magnetic areas or poles 40 shown either during its forming process or thereafter by the selective application of magnetic flux. Such material and/or the disc may be purchased from Tengam Engineering Inc. of Otsego MI, 45078. Although this is the preferred source of discs 38 it will be realized that such disc may be made in any other desired manner such as by constructing disc 38 of non-magnetic material having embedded therein discrete magnets arranged to create the polar pattern shown. By means to be described the rotation of the shaft 30 and disc 38 is limited to 45° with each of the permanent magnet poles 40 moving in one 45° arc which is solely contained between the same two pole ends 34. (The polar magnetized areas 40 are delineated even though they are not discrete and only differ from adjacent material in intensity and direction of magnetization.) Thus a permanent magnet pole 40 does not rotate 45° on an arc which would cause any pole 40 pass a pole end 34. Preferably the 45° arcs are located midway between pole ends 34 so that a permanent magnet pole 40 has an arc of movement from a location 22½° from one adjacent pole end, all as indicated in FIGS. 7 and 8.

Movable vanes 20 are mounted to project outwardly from sleeve 22 having rearward of the vanes a thickened hub 44. Passing through the walls of the hub 44 are a pair of diametrically opposed axially extending slots 46. The sleeve 22 is slidably mounted on an extension 48 of shaft 30 projecting in the viewing direction beyond the forward one of permanent magnets 38. Shaft extension 48 mounts a diametrical pin 52 forming a pair diametrically opposed outwardly projecting studs preferably mounting on their ends roller bearings 50 which studs and/or bearings are designed to ride in axial slots 46. (As shown the two studs are preferably formed of a single pin 52 extending through a bore 54 in extension 48.) Thus the studs 52 and slots 46 key the vanes 20, and sleeve 22 to the shaft 48-30 for rotation therewith while allowing movement of the vanes and sleeve through the axial displacement necessary to move the vanes from their occluded to their exposed position. (Compare the axial positions of the sleeve in FIGS. 5 and 6.) To control such vane movement, hub 44 of sleeve 22, is provided on its outer surface with a pair of inwardly directed helical grooves 58. Frame 24 mounts inwardly directed studs preferably with roller bearings 60 that ride in said slots 58. The slots 58 are located, oriented and directed to act as a helical cam, so that when shaft 48-30 rotates the vanes 20 in one direction (counter clockwise in FIGS. 1 and 2) the studs 60 moving in helical slots 58 urge the vanes 20 from the position of FIGS. 1 and 5, between fixed vanes 14 (see FIG. 9) and in front of fixed vanes 14, to the position of FIGS. 2 and 6. When shaft 48-30 rotates the vanes 20 in the other direction, (clockwise in FIGS. 1 and 2) the studs 60 and helical slots 58 urge the vanes in the reverse direction toward the position behind the fixed vanes. The lengths of the helical slots are also selected to set the preferred 45° limits of vane 20 movement between exposed and occluded position for the movable vanes 20.

(It will be noted that movement of the vanes 20 to limiting positions beyond the 45° spaced limits '45° is the arc subtended by the vanes' would still allow correct operation of the device in the sense that the device would show white at one limiting position and black at the other.) However, such extended rotation would necessarily add axial depth to the device and might alter the magnetic drive details from those expalined in relation to the 45° preferred arc of movement. It should also be noted, with particular reference to FIGS. 7 and 8 that the allowed arc of movement cannot be such as to allow the permanent magnet poles 40 to align or pass the arcuate position of core ends 34. Such alignment or passing would cause hang-up or locking respectively, and prevent operation of the device.

In operation then with the vanes 20 in occluded position (FIGS. 1, 5 and 7) cores 34 polarized as shown in FIG. 7 are polarized to draw the magnets 34 toward such position. (The vanes 14 then, as best illustrated in FIG. 1 are then showing their dark, background colour in the viewing direction.) If the four cores are energized by windings 36 so that their polarity is reversed then core ends 34 are switched to the polarities shown in FIG. 8 to have the same polarity as the adjacent magnet poles 40 repelling the latter causing counter-clockwise movement from the viewers position. The repelling of poles 40 to cause such counter-clockwise movement is of course due to the component of the repulsion force which is in the rotary direction (i.e. in the plane of the drawings). However it is noted that since permanent magnet discs 38 are axially displaced outside of core ends 34. Thus the repulsion causing the rotation initially has an axial component which tends to create approximately equal spacing between relating magnets 34 and the pole ends 40. This reduces friction and hence initially reduces resistance to starting torque and assists in the switching of the device. Consequent rotation of the shaft 48-30 rotates sleeve 22 and vanes 20 through studs 50 in slots 46 and under the control of studs 60 in slots 58 causing vanes 20 to move counter-clockwise and forward. Thus the vanes 20 pass between the fixed vanes 14 and come to rest occluding the fixed vanes (as shown in FIGS. 2, 6 and 8). The device then displays, in the viewing direction, the white, (contrasting with the background) colour of vanes 20. Further reversal through windings 36 of the polarity of the cores to again return the core ends to the polarization of FIG. 7 causes rotation from the position of FIGS. 2, 6 and 8 to the position of FIGS. 1, 5 and 7. Once again the core reversal initially has an axial repulsion component which centres the members 38 relative to ends 34 and initially reduces resistance to starting torque. It will be noted that the rotary travel of the vanes 20 in this arrangement may be greater than 45° (but within the angular criteria that prevent a permanent magnet 40 from reaching the arcuate position of a core end 34).

It is noted that there is no limitation to 8 vanes or 45° movement or to four cores and four permanent magnets. The minimum number of cores is one and this may drive any angular rotation of less than 180°.

FIGS. 10 and 11 are shown as an alternative to the arrangement of FIGS. 7 and 8. The numbering of elements is the same as FIGS. 7 and 8 with 100 added. There will be four fixed and four movable vanes each subtending 90° of arc (not shown) with the movable vanes able to move between the fixed vanes by analogy to the movement shown for the preferred embodiment. Two axially extending cores 134 control the movement of the movable vanes through attraction and repulsion of two permanent magnets 140 on a disc 138 physically identical to disc 38. The permanent magnets as shown are caused to move in 90° arcs between limiting positions 45° off one core 134 to a position 45° off the other. The movable vanes are arranged relative to the 90° arc of movement so that such arc represents the transition between occluded and exposed position for the movable vanes. Since, as in the preferred embodiment, the permanent magnets 140 are each located axially outwardly of the core ends 134 there is, again as in the preferred embodiment an axial repulsion force between the cores 134 and the magnets 140, each time the cores 134 are switched which centres the rotor relative to the stator and promotes a low friction drive.

It will further be noted that, with the preferred embodiment, eight core poles (four at each end) are driving eight permanent magnet poles (four at each end) for a highly powerful and efficient drive. This is much more powerful than the four (two at each end) cores and magnets of the embodiment of FIGS. 10 and 11 both because of the number of magnetic driving members and because the magnetic attraction and repulsion spaces are smaller (and hence the magnetic force more powerful by a square law) with the FIGS. 1–9 embodiment.

It will be noted that cores and permanent magnets need not be used in axially spaced pairs but that single sets of magnets may be used at one end only of the rotor, with the ends 34 of cores 32 used only at the same ends. However the self centering magnetic feature immediately after switching will then be lost.

The invention also extends to applications where all the core ends at one end of the device are of the same polarity. This usually implies that there will preferably be two permanent magnets for each core (and at each end if both ends of the core are used). Reference has already been made to the use of a single core which would operate best with a north (N) and a south (S) permanent magnet at the functionary core ends. The use of half as many cores and permanent magnets may be further illustrated by considering FIGS. 7 and 8 with core ends 34 at the 12 and 6 o'clock positions but without the cores having the core ends at the 3 and 9 o'clock positions. The four permanent magnets 40 are still located as shown and all other parts are the same. Thus in FIG. 7 the 12 and 6 o'clock core ends are both north (N) and in FIG. 8 they are both south (S). It is quite obvious that the device will still operate between two positions with change between light and dark appearance although with much less torque. Moreover this need only be done at one end. (However with further reduction in torque and loss of the self-centering feature). These alternatives are within the scope of the invention although of much less certainty of operation and switching speed as the form shown in the preferred embodiment.

The use of the helical vanes moving through fixed vanes is not limited in its inventive aspects to a magnetic drive (but such magnetic drive is felt to be the most efficient).

I claim:

1. Display or indicator element defining a viewing direction comprising:

a first set of vanes together encompassing a first predetermined area in the viewing direction, each of said vanes defining a substantially equal angle, said vanes conforming approximately to the locus of a line perpendicular to an axis extending in said viewing direction with each point on the line describing an approximate helix relative to said axis, said vanes being so shaped and arranged that a similar set of vanes may be rotated in one sense and axially advanced and rotated in the opposite sense and axially retracted relative to the first between a first position where said similar set of vanes is occluded by the first in the viewing direction and a second position where said second set of vanes occludes the first in the viewing direction, a similar set of movable vanes mounted to so move between said first and second positions, stop means designed to stop movement of said similar set of vanes at said first and said second positions, a guide connection between a member movable with said similar vanes and a stationary member for causing said similar vanes to be so axially advanced and retracted on rotation in one and in the opposite direction of said similar vanes, means for moving said similar set of vanes between said two positions.

2. Display or indicating element including:

a frame, a display member rotatably mounted thereon to rotate about an axis of rotation relative thereto, said axis of rotation corresponding roughly to the viewing direction for said element, means limiting the angular rotation of said member to rotation between two predetermined limiting positions, said display member being arranged and mounted to advance and retract axially on rotation in one and in the other direction, respectively, between said two limiting positions, said display member comprising a plurality of movable vanes encompassing, in the viewing direction, a first predetermined area a plurality of stationary vanes of appearance contrasting with said movable vanes encompassing a predetermined area corresponding to said first area, said movable vanes and said stationary vanes being so shaped and arranged relative to each other that each movable vane passes between a pair of stationary vanes in moving between said two limiting positions and so that, in one limiting position the movable vanes are substantially occluded by the fixed vanes in the viewing direction and, in the other limiting position the fixed vanes are substantially occluded by the movable vanes, a guide connection between a member movable with said movable vanes and a stationary member for causing said axial displacement on rotation of said rotary vanes, means for controlling the such rotation of said movable vanes.

3. Display element as claimed in claim 1 or claim 2 wherein said means for controlling said movable vanes comprises:

at least one stationary reversible permanently magnetizable magnetic member, extending between a first and a second free end, said free ends being displaced from each other in the axial direction, an electrical energizing coil corresponding to each magnetizable member, for magnetizing the latter in either polarity, first and second permanent magnets mounted on and rotatable with said display member respectively outwardly of said first and second free ends, each of said first and second magnets being located and oriented so that for either magnetization of said at least one magnetizable element, the flux from said magnetizable element end will exert torque in one sense on the corresponding magnet on rotation of said magnet over the range of rotation between said two limiting positions, and so that said torque will be in the same sense for both magnets.

4. A display or indicating element as claimed in claim 3 wherein there are provided eight fixed and eight movable vanes, each of such vanes subtending approximately 45° in said viewing direction, wherefor said movement between limiting positions is substantially 45°, four reversible permanently magnetizable magnetic members, arranged approximately symmetrically about said shaft, each permanently magnetizable magnetic member extending longitudinally between first and second free ends with its major component in the axial direction of said shaft, an electrical energizing coil corresponding to each magnetizable element for magnetizing the latter, the four free ends extending in one direction defining pole pieces at approximately each 90° of arc, four permanent magnet poles mounted on said shaft outwardly of each set of our free ends with each pole located to rotate through a 45° portion of one of said 90° arcs, whereby, with said magnetizable members magnetized to present at each end alternating north and south poles, said permanent magnets will cause said shaft to rotate through said 45° range of movement on each reversal of magnetization of said four magnetizable elements, said permanent magnets being arranged relative to each other and to the respectively adjacent pair of four pole pieces that whichever the magnetization of said magnetizable elements the torque is in the same sense on both permanent magnets.

5. A display or indicating element as claimed in claim 1 or 2 wherein said movable vanes are driven by a rotating drive member, said drive member comprising a rotating shaft, said movable vanes being attached to a sleeve about said shaft, means for keying said sleeve to said shaft for rotation therewith, said keying means allowing axial movement of said movable vanes relative to said sleeve for displacement of said movable vanes during movement between limiting positions and between said stationary vanes.

6. A display or indicating element as claimed in claim 5 wherein there is provided:

at least one stationary reversible permanently magnetizable magnetic member, extending between a first and a second free end, an electrical energizing coil corresponding to each magnetizable member for magnetizing the latter in either polarity, first and second permanent magnets mounted on and rotatable with said shaft, respectively, outwardly of said first and second free ends, each of said first and second magnets being located and oriented so that for either magnetization of said at least one magnetizable member, the flux from each end of said magnetizable element will exert torque in one sense on the corresponding permanent magnet, on rotation of said shaft between said two vane limiting positions and so that said torque will be in the same sense for both magnets.

7. A display or indicating element as claimed in claim 1 or claim 2 wherein there is provided:

a permanent magnet rotating with said movable vanes defining a magnetic field with a component transverse to the rotation axis of said shaft, means for providing a reversible magnetic field in the locus of said permanent magnet magnetic field effective on each reversal to move said shaft, through said permanent magnet, from one limiting position to the other.

8. A display or indicating element as claimed in claim 1 or claim 2 wherein there are provided four fixed and four movable vanes, each of said vanes subtending approximately 90° in said viewing direction, wherefore said movement between said positions is substantially 90°, a pair of stationary reversible permanently magnetizable magnetic members, each having a free end, an electrical energizing coil corresponding to each magnetizable element for magnetizing the latter, said two free ends definging a gap between them, at least one permanent magnet mounted on and rotatable with said movable vanes, said at least one permanent magnet being located and oriented so that for either, opposite, magnetization of said magnetizable members the flux across said gap will exert torque in one sense on the at least one permanent magnet, on rotation of said magnet over said 90° range of movement.

* * * * *